US010005612B2

(12) United States Patent
Jiang et al.

(10) Patent No.: US 10,005,612 B2
(45) Date of Patent: Jun. 26, 2018

(54) TUBE LAMP PACKAGING ASSEMBLY

(71) Applicant: JIAXING SUPER LIGHTING ELECTRIC APPLIANCE CO., LTD, Jiaxing (CN)

(72) Inventors: Tao Jiang, Jiaxing (CN); Zhen-Zhen Zhang, Jiaxing (CN); Wen-Jun He, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 167 days.

(21) Appl. No.: 15/016,305

(22) Filed: Feb. 5, 2016

(65) Prior Publication Data

US 2016/0229621 A1 Aug. 11, 2016

(30) Foreign Application Priority Data

Feb. 10, 2015 (CN) ..... 2015 1 0068182

(51) Int. Cl.

| | |
|---|---|
| ***B65D 85/42*** | (2006.01) |
| ***B65D 77/26*** | (2006.01) |
| ***B65D 81/113*** | (2006.01) |
| *B65D 5/50* | (2006.01) |

(52) U.S. Cl.

CPC ..... *B65D 85/42* (2013.01); *B65D 77/26* (2013.01); *B65D 81/113* (2013.01); *B65D 5/503* (2013.01); *B65D 2581/053* (2013.01)

(58) Field of Classification Search

CPC ..... B65D 5/5035; B65D 71/70; B65D 77/26; B65D 81/113; B65D 85/20; B65D 85/45

USPC ..... 206/418–422, 499, 500

See application file for complete search history.

(56) References Cited

U.S. PATENT DOCUMENTS

| | | | | |
|---|---|---|---|---|
| 2,568,769 A * | 9/1951 | Shepard | B65D 5/503 | 206/419 |
| 4,427,730 A * | 1/1984 | Robbins | B65D 1/36 | 206/419 |
| 4,942,965 A * | 7/1990 | Comer | B65D 71/70 | 206/419 |

(Continued)

FOREIGN PATENT DOCUMENTS

| | | | |
|---|---|---|---|
| CN | 204802382 | 11/2015 | |
| GB | 857010 A * | 12/1960 | B65D 5/503 |

*Primary Examiner* — Anthony Stashick
*Assistant Examiner* — Mollie Impink
(74) *Attorney, Agent, or Firm* — Ding Yu Tan

(57) ABSTRACT

A tube lamp packaging assembly designed for holding tube lamps, having end packing trays, middle packing trays and a carton box is disclosed. End packing trays and the middle packing trays have two recesses formed on upper and lower portions thereof, respectively, which are shaped in trough, matchingly aligned, and staggeredly disposed along parallel direction to axial direction of tube lamp. End packing trays and middle packing trays are stackingly arranged, with two recesses thereof being substantially symmetrical and forming a cavity therebetween for fittingly accommodating tube lamp residing therebetween. The end packing tray has metal pin slots and a limiting protruding portion disposed at one end of a first recess for fittingly carry the lamp tube, in which the metal pin slots are formed between the limiting protruding portion, and are sized so that metal pins of lamp tubes do not directly contact thereof.

20 Claims, 13 Drawing Sheets

(56) References Cited

U.S. PATENT DOCUMENTS

| | | | | | |
|---|---|---|---|---|---|
| 5,016,751 | A * | 5/1991 | Creaden | B65D 85/42 | 206/419 |
| 5,058,744 | A * | 10/1991 | Creaden | B65D 85/42 | 206/419 |
| 6,098,803 | A * | 8/2000 | Tanaka | B65D 19/16 | 206/386 |
| 8,376,136 | B2 * | 2/2013 | Arai | B65D 5/5057 | 206/419 |
| 2013/0092585 | A1 * | 4/2013 | Ramirez | B65D 81/133 | 206/419 |

* cited by examiner

TUBE LAMP PACKAGING ASSEMBLY

FIELD OF THE INVENTION

The present invention relates to a packaging assembly, and more particularly to a tube lamp packaging assembly configured for holding a plurality of tube lamps.

BACKGROUND OF THE INVENTION

During transportation, warehousing or storage of packaged tube lamps during normal operations, the tube lamps are often subjected to potential dangers such as accidental breakages or damages caused by inadvertent shock or exerted force thereupon (i.e. dropping of the entire carton box or pallet containing the tube lamps onto the floor, or sudden shake of the entire carton box or pallet by an outside object or being hit by an outside object or person). In addition, due to fragile nature of glass tube lamps, chances for breakages and damages for the tube lamps to occur are sometimes quite significant. The tube lamps can include, for example, LED tube lamps and fluorescent tube lamps. Conventionally, OEM shipping boxes have been particularly-sized for packaging tube lamps therein, regardless of whether the tube lamps are fluorescent tube lamps or LED tube lamps, so as to improve upon the integrity and security of the packaged tube lamps therein, and such shipping boxes are typically constructed of corrugated paper cardboard. Nevertheless, packaged tube lamps are still found to suffer from occasionally accidental breakages. Thus there is still room for improvement in the designing and provisioning of a tube lamp packaging assembly for tube lamps, wherein adapted and configured for more securely housing a plurality of tube lamps therein.

SUMMARY OF THE INVENTION

To solve at least one of the above problems, the present invention provides a tube lamp packaging assembly according to at least one embodiment for securely holding tube lamps inside a carton box and allowing the tube lamps to efficiently filling the carton box without having excessive wasted empty spaces therein during storage or shipping. In addition, the tube lamp packaging assembly of the embodiments of present invention can prevent the tube lamps to be securely residing therein so as to be free from generating excessive motion, twisting or rotating.

According to one embodiment, the present invention provides a tube lamp packaging assembly which includes a plurality of end packing trays and a carton box. The tube lamp packaging assembly is specifically designed, sized and configured for holding tube lamps of a specified size dimension. A plurality of first recesses are configured and formed on an upper surface of each of the end packing trays, and a plurality of second recesses are configured and formed on a lower surface of each of the end packing trays, in which the first recesses and the second recesses are matchingly aligned, respectively, which means that the first recesses (being disposed on upper surface of the end packing tray) are facing in opposite directions (away from each other) from the second recesses (being disposed on the lower surface of the end packing tray) on different sides of the end packing tray. Meanwhile, the first recesses and the second recesses, being matchingly aligned, are substantially parallel with respect to each other and are disposed along a perpendicular direction to an axial direction of the tube lamps, respectively, in staggeredly-arranged configuration. For each end packing tray, quantity or number of the first recesses is more than the quantity or number of the second recesses. In addition, at least one metal pin slot is formed at one end of the first recess located at a far end of the end packing tray, in which each end packing tray contains a plurality of metal pin slots disposed substantially parallel along a perpendicular direction to the axial direction of the tube lamps. The end packing trays are disposed inside the carton box.

According to the one embodiment, the tube lamps do not touch one another while being stored inside the carton box of the tube lamp packaging assembly.

According to the one embodiment, the first recesses and the second recesses of the end packing tray are of trough or semi-circular trough in shape, respectively.

According to the one embodiment, a limiting protruding portion is disposed at an end of the first recess located at a far end of each of the end packing trays, and an abutting end portion is disposed at an end of the second recess located at a far end of each of the end packing trays.

According to the one embodiment, more than one end packing trays can be stackingly arranged inside the carton box, in which corners and edges (or sides) thereof are substantially aligned, respectively. The first recess of one end packing tray and the second recess of an another end packing tray, that is adjacent to the one end packing tray, are stackingly aligned vertically and directly-fitted together, with the shape and profile of the first recesses and the shape and profile of the second recesses of the end packing trays being substantially the same to each other thereby forming a cavity therebetween for fittingly accommodating the (cylindrically-shaped) tube lamp residing therebetween.

According to the one embodiment, the one end packing tray can be directly contacting the other end packing tray so that lesser amount of free space are available for the packaged tube lamps to be inadvertently moving around inside the carton box.

According to the one embodiment, the first recesses of the end packing tray are arranged to be aligned in a width direction, the second recesses are also arranged to be aligned in the (same) width direction, while the first recesses are spatially arranged from the second recesses in a staggered manner in the width direction in each end packing tray, in which the width direction is perpendicular to an axial direction of the tube lamp. The first recesses and the second recesses are facing in opposite directions vertically thereof.

According to the one embodiment, the tube lamp packaging assembly further includes a plurality of middle packing trays. Each of the middle packing trays can be placed in between two end packing trays inside the carton box. A plurality of third recesses are formed on one surface/side of each of the middle packing trays, a plurality of fourth recesses are formed on an another surface/side of each of the middle packing trays. In other words, the third recesses are formed on an upper surface of the middle packing tray, and a plurality of fourth recesses are formed on a lower surface of the middle packing tray, in which the third recesses and the fourth recesses are matchingly aligned, respectively, which means that the third recesses (being on upper surface of the middle packing tray) are facing in opposite directions (away) from the fourth recesses (being on the lower surface of the middle packing tray) on different sides/surfaces of the middle packing tray. Meanwhile, the third recesses and the fourth recesses, being matchingly aligned, are substantially parallel and are disposed along perpendicularly to an axial direction of the tube lamps, respectively, in staggeredly-arranged configuration. For each middle packing tray, quantity or number of the third recesses is more than the quantity or number of the fourth recesses. The middle packing trays are disposed inside the carton box.

According to the one embodiment, more than one middle packing trays can be stackingly arranged and disposed inside the carton box, in which corners and edges and sides thereof are substantially aligned, respectively. The third recess of one middle packing tray and the fourth recess of an another middle packing tray, that is adjacent to the one middle packing tray, are directly stackingly aligned vertically and fitted together, with the shape of the third recess and the shape of the fourth recess of the (one and the another) middle packing trays being symmetrical or substantially symmetrical to each other thereby forming a cavity therebetween for fittingly accommodating cylindrical tube lamp disposed or resided therebetween. The one middle packing tray can be directly contacting the other middle packing tray so that lesser amount of free space are available for the packaged tube lamps to be inadvertently moving around inside the carton box.

According to the one embodiment, the third recesses of the middle packing tray are arranged to be aligned in a width direction, the fourth recesses are also arranged to be aligned in the same width direction, while the third recesses are spatially arranged in a staggered manner in the width direction from the fourth recesses in each middle packing tray, the width direction is perpendicular to an axial direction of the tube lamp. The third recesses and the fourth recesses are facing in opposite directions vertically thereof.

According to the one embodiment, the third recesses and the fourth recesses of the middle packing trays are of trough in shape, respectively.

According to above embodiment, the tube lamp packaging assembly includes a plurality of cavities spatially arranged along the axial direction of the tube lamps in each of the end packing trays and in each of middle packing trays, respectively, upon stacking of multiple number of end packing trays and middle packing trays, respectively. The cavity formed by the first recess and the second recess of the end packing trays and the cavity formed by the third recess and the fourth recess of the middle packing trays are collectively configured for fittingly accommodating a tube lamp having a cylindrical shape residing therebetween.

According to the above embodiment, the first recess is formed between a plurality of first supporting portions; for examples, a pair of first supporting portions are formed surrounding the first recess. A tube lamp is fittingly-disposed on the pair of the first supporting portions, so that the first supporting portions are configured for securing and carrying the tube lamp. The first supporting portions are spatially arranged substantially along the axial direction of the tube lamp. The second recess is formed between a plurality of second supporting portions; for examples, a pair of second supporting portions are formed surrounding the second recess. The tube lamp is fittingly disposed below the pair of the second supporting portions, so that the second supporting portions are configured to be fittingly-abutting the tube lamp, the second supporting portions are also spatially arranged substantially along the axial direction of the tube lamp.

The first supporting portions and the second supporting portions of the one end packing tray, respectively, along the width direction perpendicular to the axial direction of the cavity are staggeredly-arranged along the parallel direction to the axial direction of the tube lamps. Two adjacent cavities formed by the first recesses, that are (horizontally) spatially-arranged in the width direction, are at an axial distance of 3 centimeters (cm) to 6 centimeters (cm) between center lines thereof. Two adjacent cavities formed by the second recesses, that are (horizontally) spatially-arranged in the width direction, are at an axial distance of 3 centimeters (cm) to 6 centimeters (cm) between center lines thereof.

Selectively, the middle packing trays can be omitted, so that the tube lamp packaging assembly includes just the end packing trays and the carton box.

Selectively, two adjacent cavities formed by the first recesses, that are spatially-arranged in the width direction, are at an axial distance of 3 centimeters between center lines thereof. In addition, two adjacent cavities formed by the second recesses, that are spatially-arranged in the width direction, are at an axial distance of 3 centimeters between center lines thereof.

Selectively, two adjacent cavities formed by the first recesses, that are spatially-arranged in the width direction, are at an axial distance of 3.5 centimeters between center lines thereof. In addition, two adjacent cavities formed by the second recesses, that are spatially-arranged in the width direction, are at an axial distance of 3.5 centimeters between center lines thereof.

Alternatively, the first recesses and the second recesses of the end packing trays can be of rectangular trough in shape, respectively, and the third recesses and the fourth recesses of the middle packing trays can be of rectangular trough in shape, respectively.

According to the above embodiment, a plurality of metal pin slots are formed between the limiting protruding portion of the first recess of the end packing tray.

According to the one embodiment, a pair of end packing trays are disposed at two sides of each middle packing tray, respectively. In other words, one end packing tray is disposed at one side of the middle packing tray.

According to the above embodiment, the third recess is formed between a plurality of third supporting portions of the middle packing tray; for examples, a pair of third supporting portions are formed surrounding the third recess. A tube lamp can be fittingly-disposed on the pair of the third supporting portions, so that the third supporting portions are configured for securing and carrying the tube lamp. The third supporting portions are spatially-arranged substantially along the axial direction of the tube lamp, the fourth recess is formed between a plurality of fourth supporting portions of the middle packing tray; for examples, a pair of fourth supporting portions are formed surrounding the fourth recess. The tube lamp is fittingly disposed below the pair of the fourth supporting portions, so that the fourth supporting portions are configured to be fittingly abutting the tube lamp, the fourth supporting portions are also spatially arranged substantially along the axial direction of the tube lamp. In other words, the fourth supporting portions are disposed above each of the tube lamps. The third supporting portions and the fourth supporting portions of the one middle packing tray, respectively, along the width direction substantially perpendicular to the axial direction of the cavity are staggeredly-arranged along the parallel direction of the tube lamp.

According to the above embodiment, width of the first recess, the second recess, the third recess, and the fourth recess, respectively, are larger than or equal to 100% of width of the tube lamp and lesser than or equal to 105% of width of the tube lamp.

According to the above embodiment, the limiting protruding portions are configured to be disposed abutting and directly contacting both ends of the tube lamps, and edge of each of the end packing trays is configured to be abutting and directly contacting a sidewall of the carton box, the metal pin slots are sized so that metal pins of the tube lamps do not directly contact the metal pin slots formed at the one end of the first recess of the end packing tray.

According to the above embodiment, the end packing trays and the middle packing trays can be made of paper, cardboard, paperboard, recycled paper, rigid plastic, polystyrene foam, biodegradable plastic, foam plastic, or recycled plastic. The carton box can be made of paper, cardboard, paperboard, recycled paper, biodegradable plastic or recycled plastic.

According to the one embodiment, each of the end packing trays disposed at two sides of each of the middle packing trays does not directly contact the middle packing tray.

By having the tube lamps fittingly-accommodated and securely-disposed in the cavities between the first recesses and the second recesses of the end packing trays, and fittingly-accommodated and securely-disposed in the cavities between the third recesses and the fourth recesses of the middle packing trays, together with having the limiting protruding portions of the end packing trays securely and firmly abutting both ends of the tube lamp while the metal pin slots do not directly contact the metal pins of the tube lamp and having the abutting end portion of same end packing trays securely and firmly abutting both ends of another tube lamp, one or ore tube lamps can be securely contained inside the carton box during transport or storage and protected against damages caused by outside shock or vibrations. As a result, the present invention provides a tube lamp packaging assembly that can prevent the tube lamps from excessive motion, twisting or rotating.

Meanwhile, the designed structure of the end packing trays and the middle packing trays also allows for efficient filling of more tube lamps inside the carton box without creating excessive wasted empty spaces therebetween during storage/warehousing or shipping. In other words, the packing density of tube lamps inside the carton box is relatively high using the tube lamp packaging assembly of the above embodiment.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
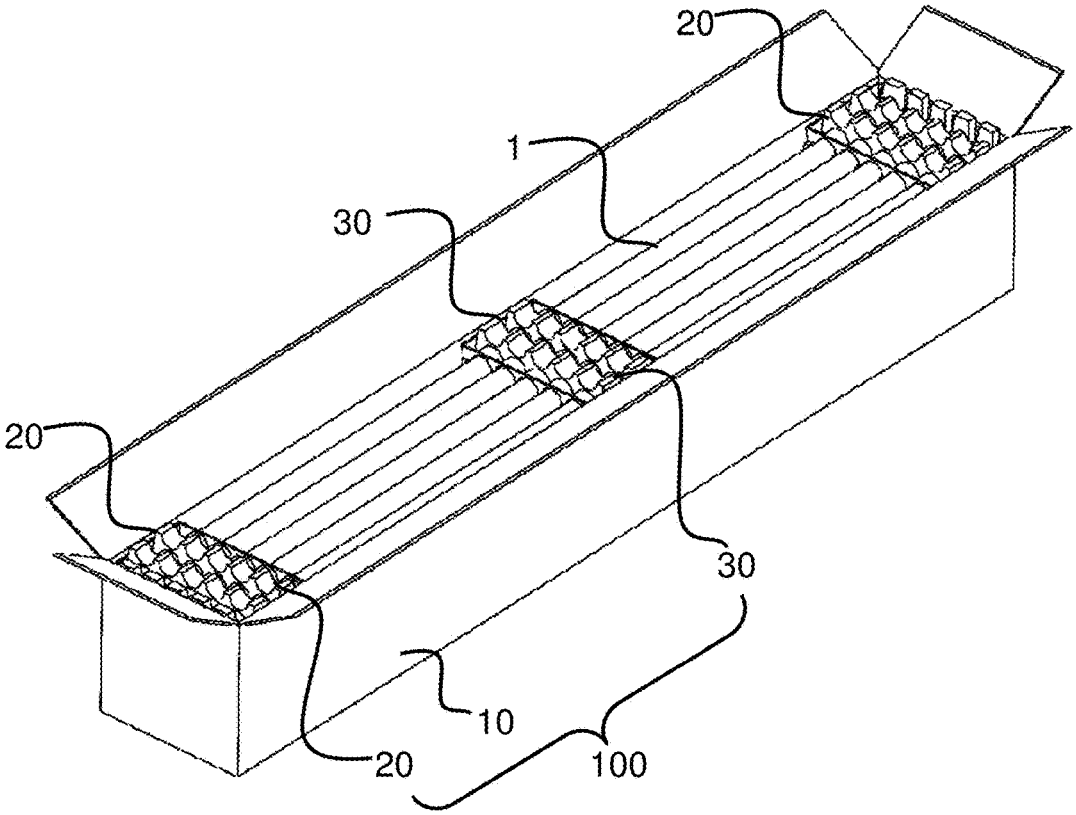
FIG. 1 is a perspective view of a tube lamp packaging assembly according to one embodiment of the present invention, in which a plurality of end packing trays and a plurality of middle packing trays are installed with a right-side-up configuration.
Figure 2:
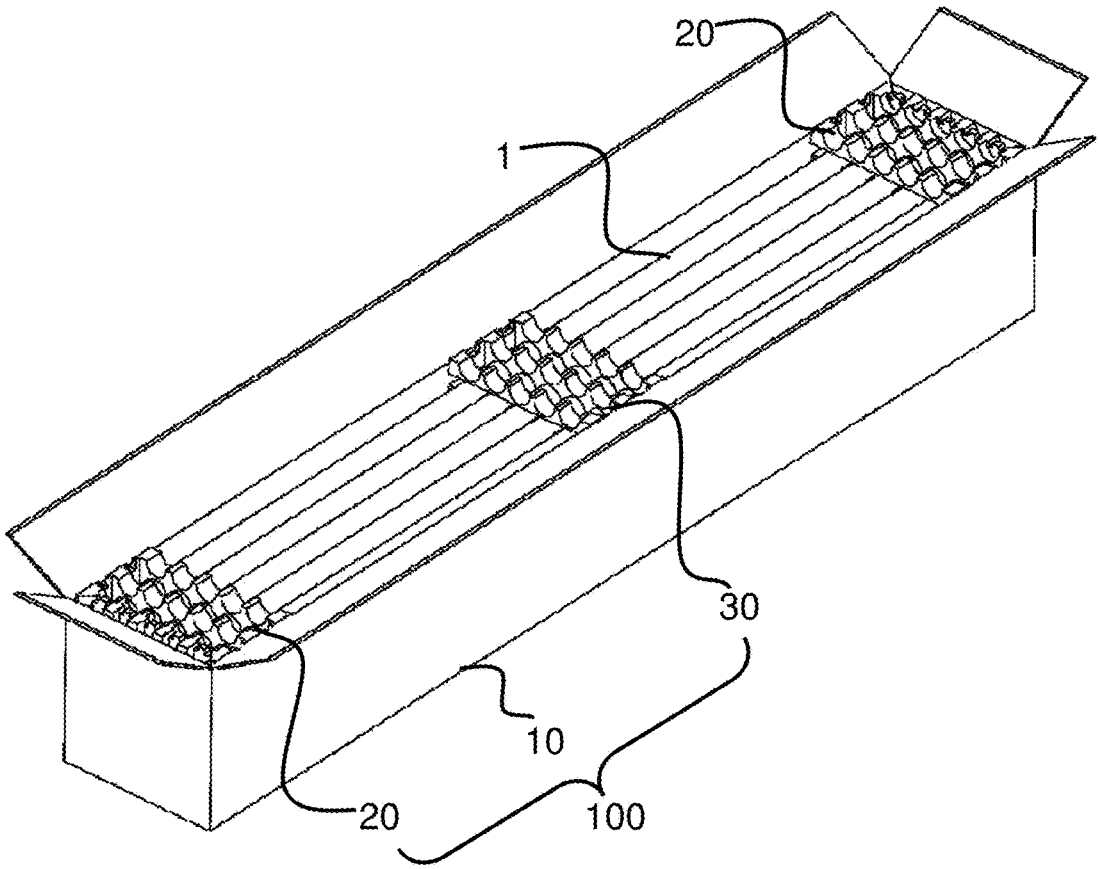
FIG. 2 is a perspective view of the tube lamp packaging assembly according to the one embodiment of the present invention, in which the end packing trays and the middle packing trays are installed with an up-side-down configuration.

As shown in perspective views of FIGS. 1-2, a tube lamp packaging assembly according to one embodiment of present invention is disclosed. The tube lamp packaging assembly 100 of the illustrated embodiment includes a plurality of end packing trays 20 and a carton box 10. The physical size and dimensions of the carton box 10 can be specifically configured for holding a desired number of tube lamps 1. A particular specified dimension, i.e. a carton size (W*H*L) for one carton box 10 can be made of dimensions (W*H*L) of 210 mm*210 mm*1910 mm for holding a plurality of tube lamps 1 of size with pins (diameter *L) of Ø28*1200 mm. The end packing trays 20 of FIG. 2 are configured and positioned same as the end packing tray 20 of FIG. 3. Meanwhile the end packing trays 20 of FIG. 1 are configured and positioned same as the end packing tray 20 of FIG. 4 But different box carton sizes can be provided for different configurations according to customer needs and requirements, such as different number of tube lamps, different types of tube lamp, i.e. T8, T6, or different carton box shape, such as triangular box.

Figure 3:
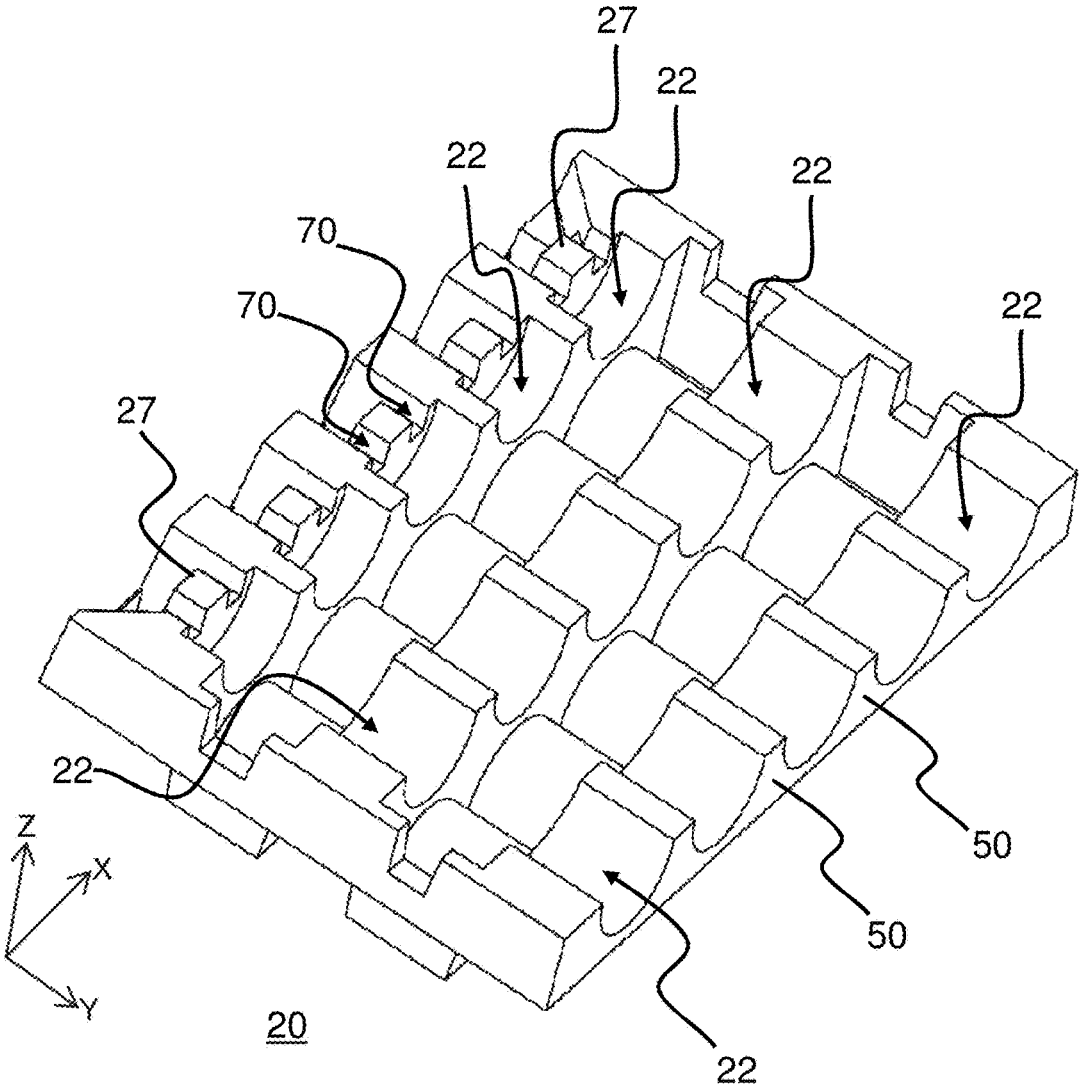
FIG. 3 is a perspective view of the end packing tray according to the one embodiment of the present invention in the right-side-up orientation.
Figure 4:
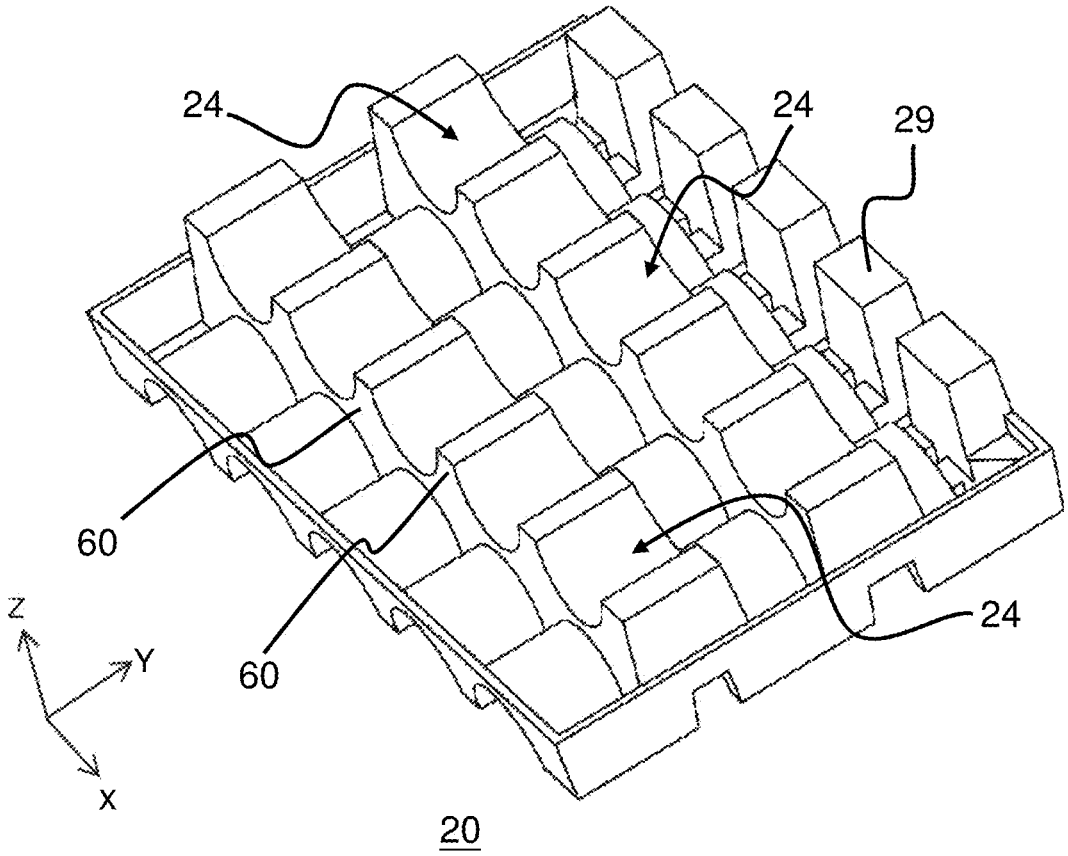
FIG. 4 is a perspective view of the end packing tray according to the one embodiment of the present invention in the up-side-down orientation.

As shown in FIGS. 3-4 under different perspective views of the end packing tray 20 taken from opposite surfaces thereof, in which FIG. 3 shows an upper surface of the end packing tray 20, and FIG. 4 shows a lower surface of the end packing tray 20, respectively. Each end packing tray 20 includes a plurality of first recesses 22 configured and formed on the upper surface thereof, and a plurality of second recesses 24 configured and formed on the lower surface thereof. The first recesses 22 and the second recesses 24 are matchingly aligned, respectively, on opposite surfaces of the end packing tray 20. In other words, the first recesses 22 (being disposed on the upper surface of the end packing tray 20) are facing in opposite directions (away from each other) from the second recesses 24 (being disposed on the lower surface of the end packing tray 20) on different sides/surfaces of the end packing tray 20. The first recesses 22 and the second recesses 24 are substantially parallel with respect to each other in an y-axis direction (in a same axial direction of the tube lamp) on opposite sides of the end packing tray 20, respectively, and the first recesses 22 and the second recesses 24 are also aligned in a x-axis direction on opposite sides of the end packing tray 20 (substantially along a perpendicular direction to an axial direction of the tube lamps 1), respectively In other words, the spatial arrangement of the first recesses 22 (in a same row) arranged along the x-axis direction is not a mirror-image of the spatial arrangement of the second recesses 24 (in a same row) arranged along the x-axis direction (on opposite surfaces of the end packing tray 20), but are staggered instead along the y-axis direction parallel to the axial direction of the tube lamp, even though the arrangement of the first recesses 22 are substantially parallel to the arrangement of the second recesses 24 along the axial direction of the tube lamps. For each end packing tray 20, a quantity or number of the first recesses 22 is more than a quantity or number of the second recesses 24. For example, the total number of the first recesses 22 for the end packing tray 20 of the illustrated embodiment in FIG. 3 is 15, while the total number of the second recesses 24 for the (same) end packing tray 20 of the illustrated embodiment in FIG. 4 is 10. In an alternative embodiment, the total number of the first recesses can be equal to the total number of the second recesses.

Figure 7A:
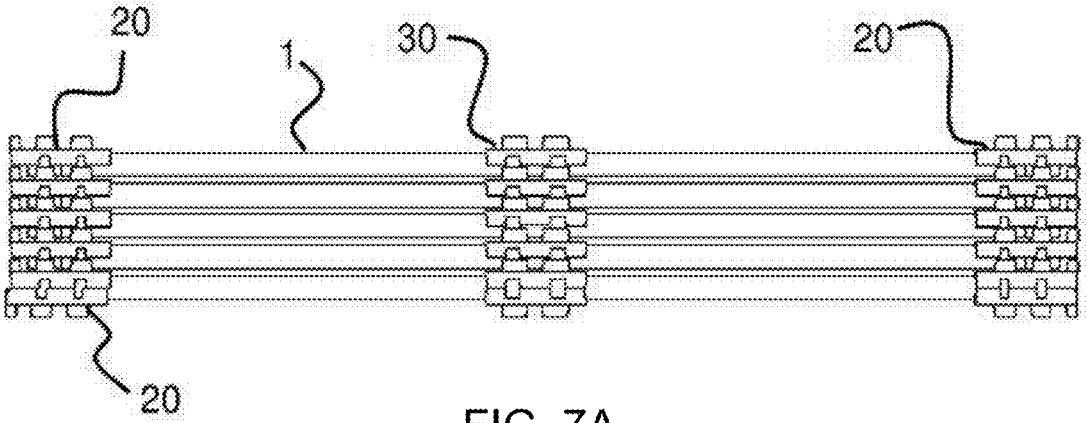
FIG. 7A is a side elevation view showing the stacking of the end packing trays, the middle packing trays, and the tube lamps inside the carton box according to the one embodiment of the present invention.
Figure 7B:
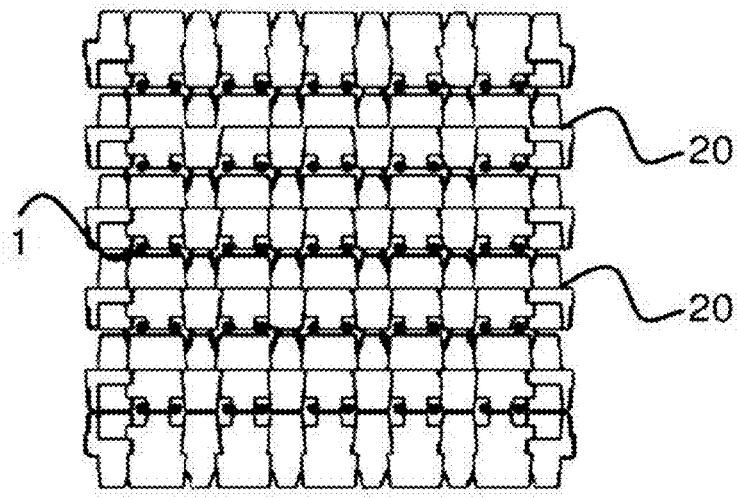
FIG. 7B is a frontal elevation view showing the stacking of the end packing trays, and the tube lamps inside the carton box according to the one embodiment of the present invention.
Figure 8:
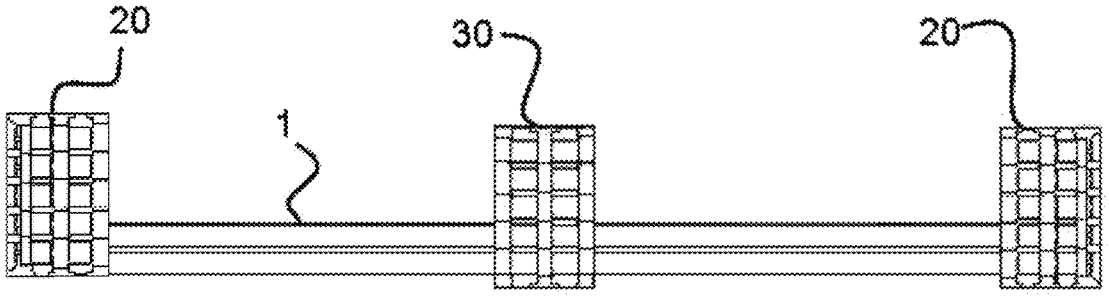
FIG. 8 is a top view showing the stacking of the tube lamps on the end packing trays and on the middle packing trays inside the carton box according to the one embodiment of the present invention.
Figure 12A:
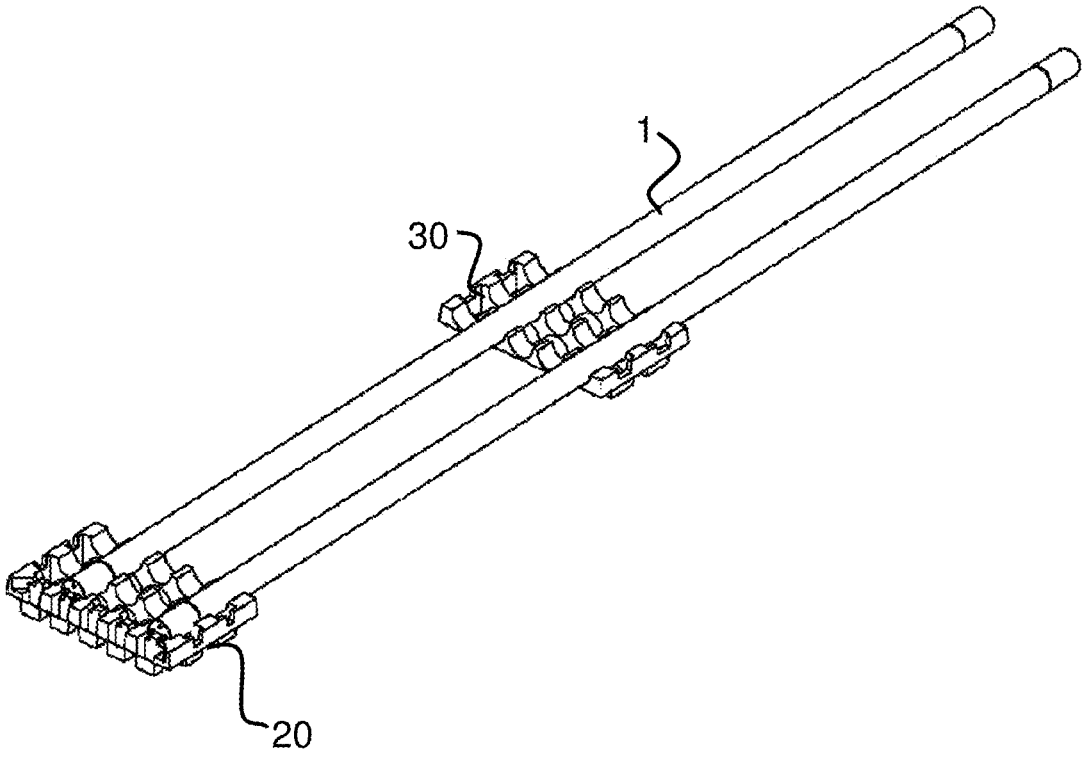
FIG. 12A is a perspective view of placement of the tube lamps showing the tube lamps being directly fittingly placed onto the end packing tray and the middle packing tray, respectively.

In the illustrated embodiment as shown in FIG. 3, the end packing tray 20 further includes a pair of first supporting portions 50, and the first recess 22 is formed between the pair of first supporting portions 50 surrounding the first recess 22. A tube lamp 1 can be fittingly-disposed between and above the pair of the first supporting portions 50, so that the first supporting portions 50 are configured for securing and carrying the tube lamp 1. The first supporting portions 50 are spatially arranged along the axial direction of the tube lamp 1. In addition, the end packing tray 20 further includes a pair of second supporting portions 60, and the second recess 24 is formed between the pair of second supporting portions 60 surrounding the second recess 24. Another tube lamp 1 can be fittingly disposed below the pair of the second supporting portions 60, so that the second supporting portions 60 are configured to be fittingly-abutting the another tube lamp 1, the second supporting portions 60 are also spatially arranged along the axial direction of the tube lamp 1. At least one metal pin slot 70 is formed at one end of the first recess 22 that is disposed at a far end of the end packing tray 20 as shown in FIG. 3. In the illustrated embodiment, the end packing tray 20 has two metal pin slots 70 disposed substantially parallel to one another along a perpendicular direction to the axial direction of the tube lamps 1 (which is the y-axis) at the first recess 22 for placement of each tube lamp 1, since each tube lamp 1 possesses two metal pins at each end thereof to be fittingly disposed within the two metal pin slots 70 of the end packing tray 20, respectively. (metal pins of the tube lamp is as shown in FIGS. 7B and 12) The metal pin slots 70 are sized so that the metal pins (not labeled, but show in FIGS. 7B and 12 of the tube lamps 1 do not directly contact the metal pin slots 70 formed at the one end of the first recess 22 located at a far end of the end packing tray 20. The end packing trays 20 are disposed inside the carton box 10, with the tube lamps 1 to be not touching one another while being stored inside the carton box 10 of the tube lamp packaging assembly 100. In the illustrated embodiment, the first recesses 22 and the second recesses 24 of the end packing tray 20 are of trough, or semi-circular trough in shape, respectively. In addition, a limiting protruding portion 27 is disposed at an end of the first recess 22 located at a far end of each of the end packing trays 20, and an abutting end portion 29 is disposed at an end of the second recess 24 of each of the end packing trays 20. The limiting protruding portion 27 is configured to be disposed abutting and directly contacting an end of the tube lamp 1, and an edge of the end packing trays 20 is configured to be abutting and directly contacting a sidewall of the carton box 10. The limiting protruding portion 27 is formed in between the metal pin slots 70 of the first recess 22 of the end packing tray 20, (semi-circular trough is one embodiment, but is not limited to that shape or structure)

Figure 5:
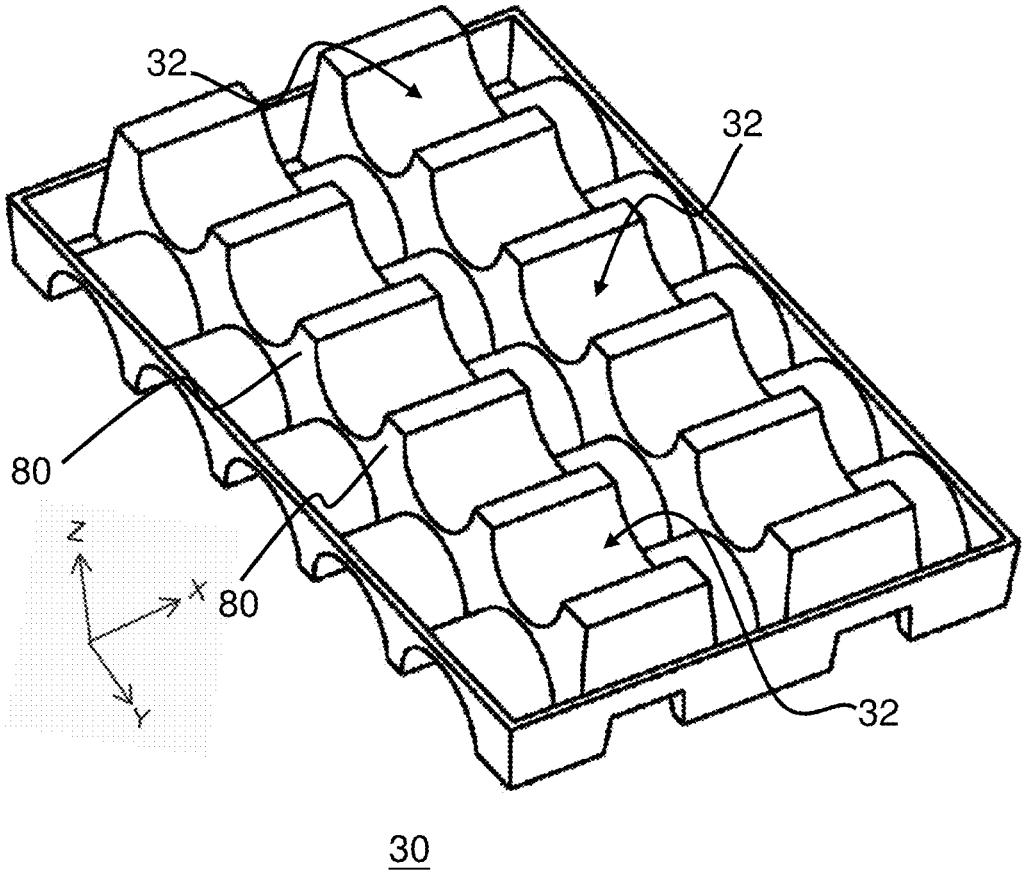
FIG. 5 is a perspective view of the middle packing tray according to the one embodiment of the present invention in the right-side-up orientation.
Figure 6:
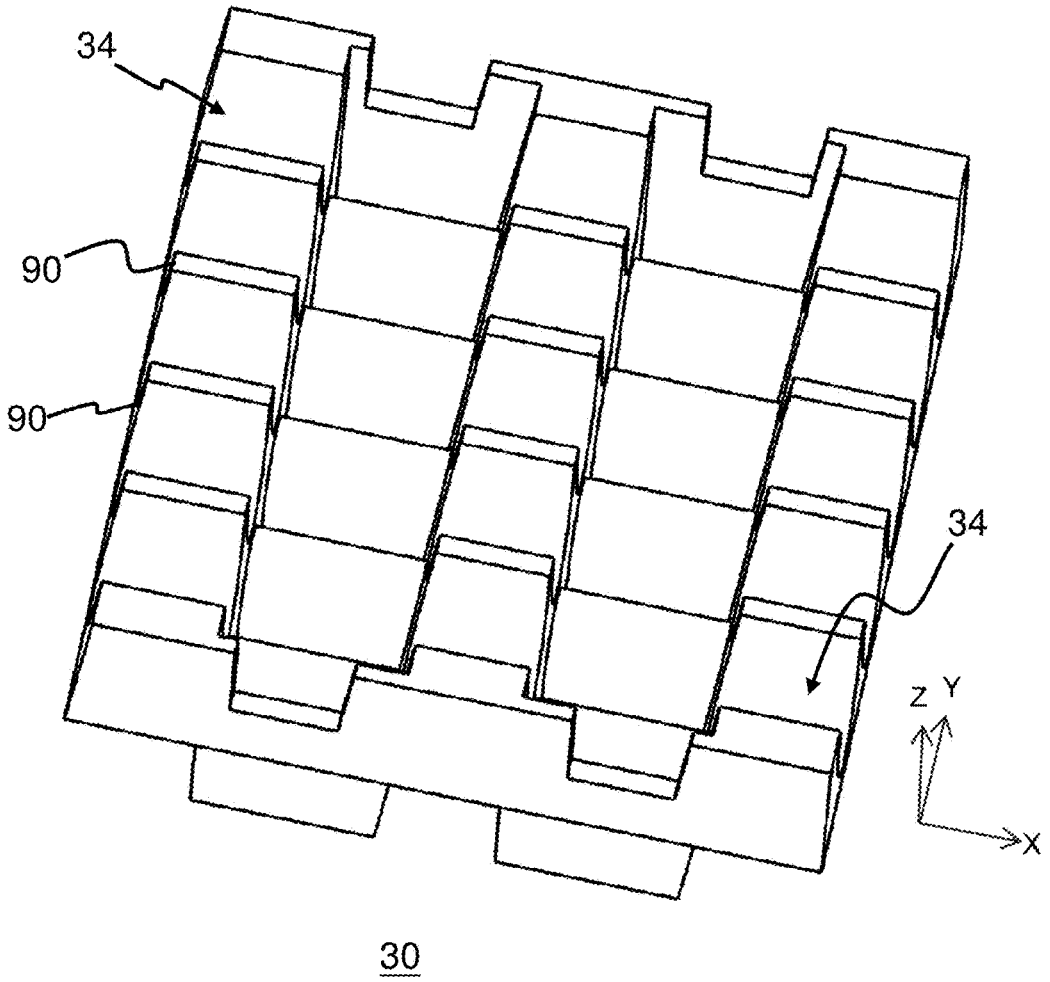
FIG. 6 is a perspective view of the middle packing tray according to the one embodiment of the present invention in the up-side-down orientation.

According to the one embodiment, the tube lamp packaging assembly 100 further includes a plurality of middle packing trays 30 as shown in FIGS. 1, 2, 7A, 8, 9, 10, 11A, 11B, and 12A. Each of the middle packing trays 30 are placed in between two end packing trays 20 inside the carton box 10 in the illustrated embodiment. As shown in FIG. 5, the middle packing trays 30 includes a plurality of third recesses 32 formed on one surface/side of each of the middle packing trays 30 in a right-side-up orientation, and as shown in FIG. 6, a plurality of fourth recesses 34 are formed on an another surface/side of each of the middle packing trays 30 as viewed in an up-side-down orientation thereof. In other words, the third recesses 32 are formed on an upper surface of the middle packing tray 30, and a plurality of fourth recesses 34 are formed on a lower surface of the middle packing tray 30, in which the third recesses 32 and the fourth recesses 34 are matchingly aligned respectively, which means that the third recesses 32 (being on upper surface of the middle packing tray 30) are facing in opposite directions (away) from the fourth recesses 34 (being on the lower surface of the middle packing tray 30) on different sides/surfaces of the middle packing tray 30. Meanwhile, the third recesses 32 and the fourth recesses 34, being matchingly aligned, are substantially parallel with respect to each other in an x-axis direction, respectively, and are disposed along perpendicularly to an axial direction of the tube lamps 1, respectively, (in a y-axis direction shown in FIGS. 5 and 6) in staggeredly-arranged configuration on opposite sides of the middle packing tray 30 along the x-axis direction. For each middle packing tray 30, quantity or number of the third recesses 32 is less than the quantity or number of the fourth recesses 34. In the illustrated embodiment as shown in FIG. 5, the total number of the third recesses 32 of the middle packing tray 30 is 10. Meanwhile, in the illustrated embodiment as shown in FIG. 6, the total number of the fourth recesses 34 is 15 for the middle packing tray 30.

In the illustrated embodiment, the total number of the first recesses and the fourth recesses are the same, the total number of the first recesses is more than the total number of the third recesses, In an alternative embodiment, the total number of the first recesses and the fourth recesses can be different. Meanwhile, the total number of the first recesses can be the same as the total number of the third recesses in another embodiment. The middle packing trays 30 are disposed inside the carton box 10 as shown in FIGS. 1 and 2 upon packaging of the tube lamps 1 inside the tube lamp packaging assembly 100. As shown in FIGS. 1, 2, 7A, 8-10, 11A, and 11B, a pair of end packing trays 20 are disposed at two sides of each middle packing tray 30, respectively. In other words, one end packing tray 20 is disposed at each side of the middle packing tray 30. Referring to FIG. 12, the tube lamps 1 can be directly fittingly placed onto the end packing tray 20 and the middle packing tray 30, so that the tube lamps 1 are fitting matched with the corresponding recesses 20, 22, 32, 34 of the end packing trays 20 and the middle packing trays 30 respectively. The middle packing trays 30 and the end packing trays 20 can be stackingly installed inside the carton box 10 with the first recesses 22 and the third recesses 32 facing upward and with the tube lamps 1 fittingly configured therein shown in FIG. 1; meanwhile, alternatively, the middle packing trays 30 and the end packing trays 20 can also be stackingly installed inside the carton box 10 with the second recesses 24 and the fourth recesses 34 facing upward and with the tube lamps 1 fittingly configured therein shown in FIG. 2. (or only the uppermost packing tray is up-side-down)

In the illustrated embodiment as shown in FIG. 5, the middle packing tray 30 further includes a pair of third supporting portions 80, and the third recess 32 is formed between the pair of third supporting portions 80 of the middle packing tray 30 surrounding the third recess 32. A tube lamp can be fittingly-disposed in between the pair of the third supporting portions 80, so that the third supporting portions 80 are configured for securing and carrying the tube lamp 1. The third supporting portions 80 are spatially-arranged along the axial direction of the tube lamp 1. In addition, as shown in FIG. 6, the middle packing tray 30 further includes a pair of fourth supporting portions 90, the fourth recess 34 is formed between the pair of fourth supporting portions 90 surrounding the fourth recess 34. Another tube lamp is fittingly disposed below the pair of the fourth supporting portions 90, so that the fourth supporting portions 90 are configured to be fittingly abutting the another tube lamp, the fourth supporting portions 90 are also spatially arranged along the axial direction of the tube lamp. In other words, the fourth supporting portions 90 are disposed above each of the tube lamps 1. The third supporting portions 80 and the fourth supporting portions 90 of the one middle packing tray 30, respectively, are staggeredly-arranged along the x-axis direction of FIGS. 5 and 6, which is parallel or substantially parallel to the axial direction of the cavity, which can be for example, cylindrical cavity.

Figure 9:
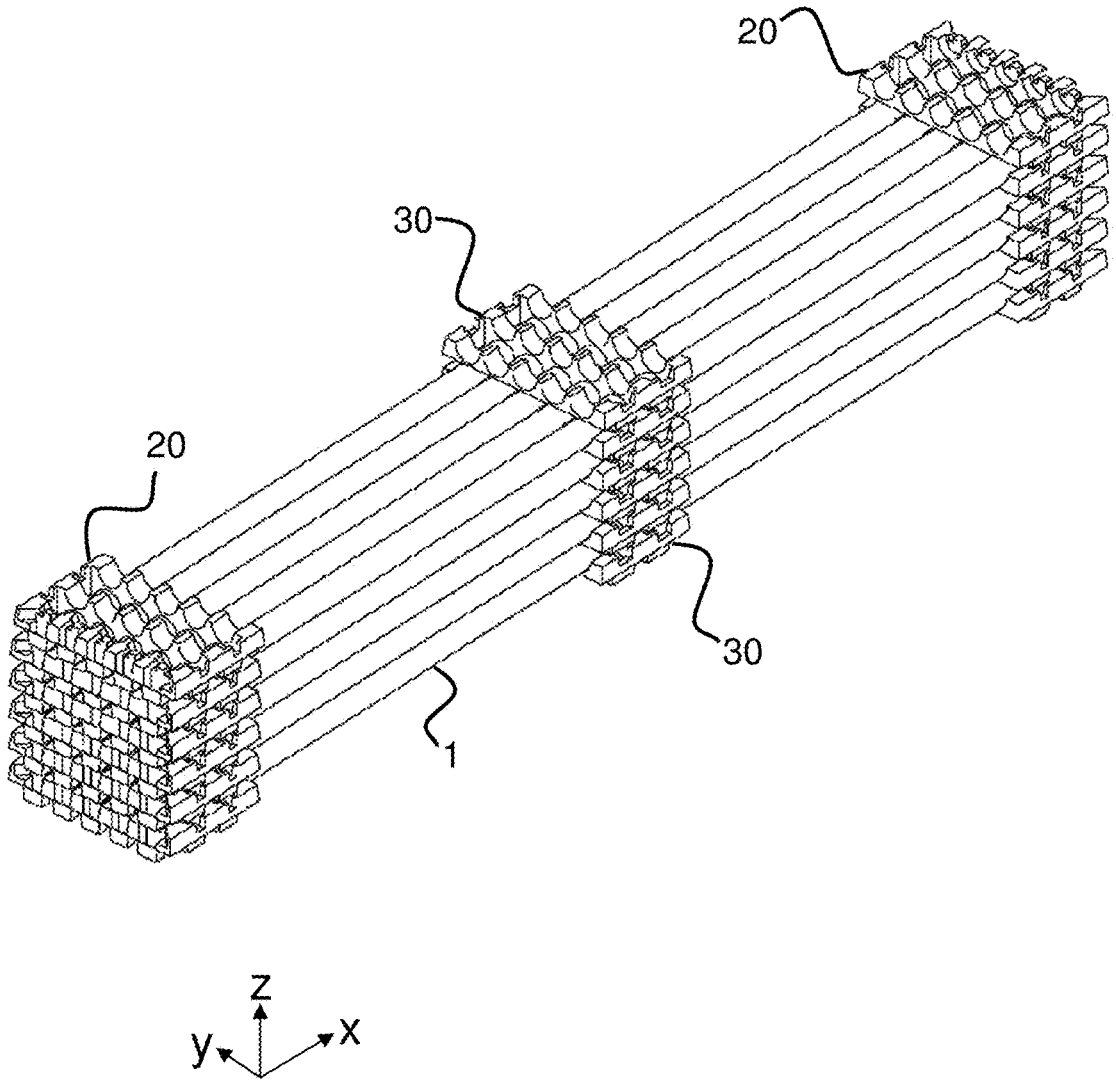
FIG. 9 is a perspective view showing stacking of tube lamps in the tube lamp packaging assembly according to the one embodiment of the present invention, in which the end packing trays and the middle packing trays are installed with the right-side-up configuration.
Figure 10:
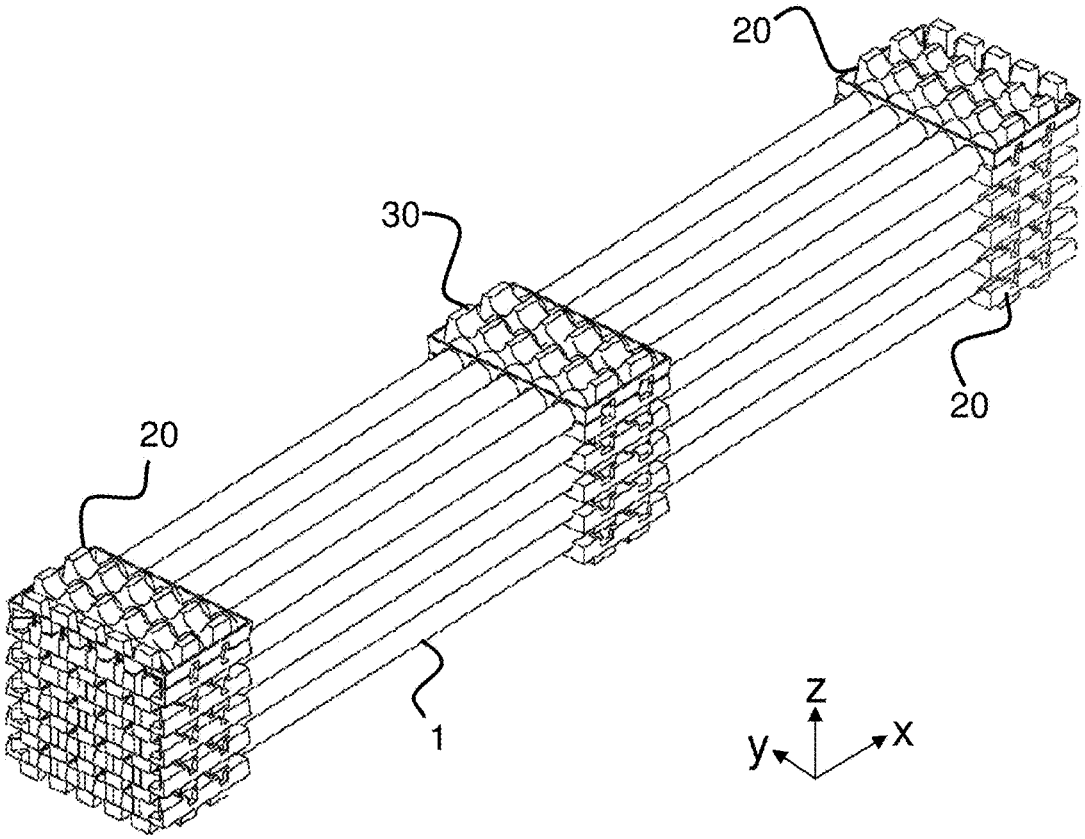
FIG. 10 is a perspective view showing stacking of tube lamps in the tube lamp packaging assembly according to the one embodiment of the present invention, in which the end packing trays and the middle packing trays are installed with the up-side-down configuration.
Figure 11A:
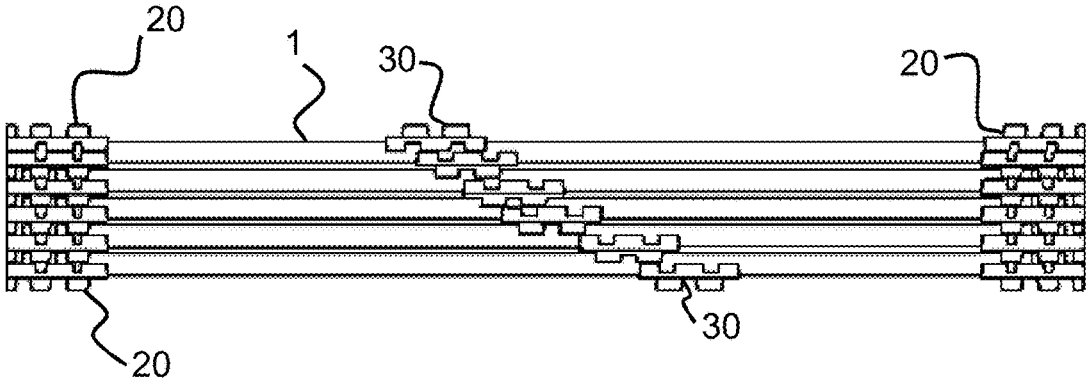
FIG. 11A is a side elevation view of an alternative stacking arrangement of the middle packing trays in an offset manner.
Figure 11B:
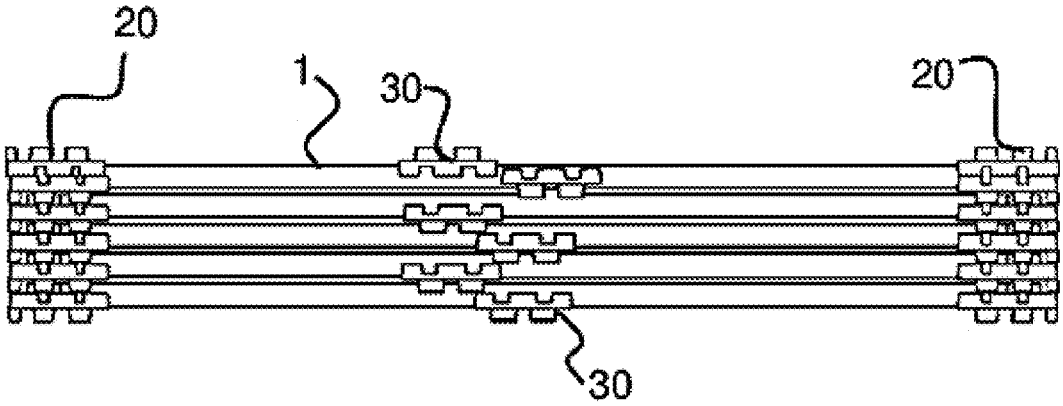
FIG. 11B is a side elevation view of a yet another alternative stacking arrangement of the middle packing trays in a back-and-forth z-letter configuration vertically.

As shown in FIGS. 7A, 7B, 8, 9 and 10, 11A, and 11B, more than one end packing trays 20 can be stackingly arranged inside the carton box 10, in which corners and edges (or sides) thereof are substantially vertically aligned, respectively. The first recess 22 of one end packing tray 20 (i.e. first end packing tray) and the second recess 24 of an another (adjacently stacked) end packing tray 20 (i.e. second end packing tray), are stackingly aligned vertically and directly-fitted together, with the shape and profile of the first recesses 22 and the shape and profile of the second recesses 24 of the (stacked) end packing trays 20 (i.e. first end packing tray and second end packing tray) being substantially the same to each other thereby forming a cavity such as for example, a cavity (having a substantially circular cross-section) therebetween for fittingly accommodating the (cylindrically-shaped) tube lamp 1 residing therebetween. The one end packing tray 20 (first end packing tray) can be directly contacting the other end packing tray 20 (second end packing tray) so as to limit the amount of free space available for the packaged tube lamps to be inadvertently moving around inside the carton box 10. In addition, the first recesses 22 of the end packing tray 20 are arranged to be aligned in a width direction or x-axis direction (please refer to FIGS. 3 and 4 for the Cartesian coordinate system showing the x-axis direction), the second recesses 24 are also arranged to be aligned in the (same) width direction or y-axis direction, while the first recesses 22 are spatially arranged from the second recesses 24 in the width direction in each end packing tray 20 in a staggered manner, in which the width direction (x-axis) is perpendicular to an axial direction (y-axis) of the tube lamp 1. The first recesses 22 and the second recesses 24 are facing in opposite directions vertically thereof. The first supporting portions 50 and the second supporting portions 60 of one end packing tray 20, respectively, arranged along the width direction (x-axis) are staggeredly-arranged substantially parallel or parallel to the axial direction of the cavity. Two adjacent cavities formed by the first recesses 22, that are (horizontally) spatially-arranged in the width direction (x-axis), are at an axial distance of 3 centimeters (cm) to 6 centimeters (cm) between center lines thereof. Two adjacent cavities formed by the second recesses 24, that are (horizontally) spatially-arranged in the width direction (x-axis), are at an axial distance of 3 centimeters (cm) to 6 centimeters (cm) between center lines thereof. For example, two adjacent cavities formed by the first recesses 22 can be at an axial distance of 3 centimeters between center lines thereof, and two adjacent cavities formed by the second recesses 24, can be an axial distance of 3 centimeters between center lines thereof. For example, alternatively, two adjacent cavities formed by the first recesses 22 can be at an axial distance of 3.5 centimeters between center lines thereof, and two adjacent cavities formed by the second recesses 24 can be at an axial distance of 3.5 centimeters between center lines thereof. Different lamp tubes can have different diameters, for example, the lamp tube diameter for T12 is 38.1 mm, the lamp tube diameter for T10 is 31.8 mm, the lamp tube diameter for T8 is 25.4 mm, the lamp tube diameter for T5 is 16 mm, the lamp tube diameter for T4 is 12.7 mm, and the lamp tube diameter for T2 is 6.4 mm, Furthermore, as shown in FIGS. 7A, 9, and 10, 11A-11B more than one middle packing trays 30 can also be stackingly arranged and disposed inside the carton box 10, in which corners and edges and sides thereof are substantially vertically aligned, respectively. The third recess 32 of one middle packing tray 30 and the fourth recess 34 of an another (adjacently stacked) middle packing tray 30, are directly stackingly aligned vertically and fitted together, with the shape and profile of the third recess 32 and the shape and profile of the fourth recess 34 of the (stacked) middle packing trays 30 being symmetrical or substantially symmetrical to each other, thereby forming a cavity such as, for example, a cavity, such as, for example, a cylindrical cavity. therebetween for fittingly accommodating cylindrical-shaped tube lamp 1 disposed or resided therebetween. The one middle packing tray 30 can be directly contacting the other middle packing tray 30 so that lesser amount of free space would be available for the packaged tube lamps to be inadvertently moving around inside the carton box 10. The third recesses 32 of the middle packing tray 30 are arranged to be aligned in a width direction or y-axis direction, the fourth recesses 34 are also arranged to be aligned in the same width direction or y-axis direction, while the third recesses 32 are spatially arranged from the fourth recesses 34 in a staggered manner in the x-axis direction in each of the middle packing trays 30, which is parallel or substantially parallel to an axial direction of the tube lamp 1. The third recesses 32 and the fourth recesses 34 are facing in opposite directions vertically thereof. In an alternative embodiment, the middle packing trays 30 can be stackingly arranged in an offset manner (i.e. not substantially aligned vertically; a different stacking arrangement of the middle packing trays 30 is shown in FIGS. 9 and 10, in which the middle packing trays 30 are stacking arranged substantially linearly in a vertical direction) as shown in a side elevation view in the illustrated embodiment of FIG. 11A. Meanwhile, as shown in FIG. 11B, yet another alternative embodiment has the middle packing trays 30 stackingly arranged in a back-and-forth z-letter configuration vertically.

In the illustrated embodiment, the third recesses 32 and the fourth recesses 34 of the middle packing trays 30 are of trough or semi-circular trough in shape, respectively. Apart from the trough shape according to the one embodiment, alternatively, the first recesses and the second recesses of the end packing trays can be of rectangular trough in shape, respectively, and the third recesses and the fourth recesses of the middle packing trays can be of rectangular trough in shape, respectively.

According to the one embodiment, the tube lamp packaging assembly 100 includes a plurality of cavities, such as for example, cylindrical cavities, spatially arranged along the axial direction of the tube lamps in each of the end packing trays 20 and in each of the middle packing trays 30, respectively, upon stacking of multiple number of the end packing trays 20 and the middle packing trays 30, respectively. The cavity formed by the first recess 22 and the second recess 24 of the end packing trays 20 and the cavity formed by the third recess 32 and the fourth recess 34 of the middle packing trays 30 are collectively configured for fittingly accommodating a tube lamp having a cylindrical shape residing therebetween, The cavities of the end packing tray 20 and the middle packing trays 30 are matchingly aligned.

According to the one embodiment, width of the first recess 22, the second recess 24, the third recess 32, and the fourth recess 34, respectively, are larger than or equal to 100% of width of the tube lamp and lesser than or equal to 105% of width of the tube lamp. More preferably, width of the first recess 22, the second recess 24, the third recess 32, and the fourth recess 34, respectively, are equal to 103% of width of the tube lamp. Different physical dimensions in width×length×height can be provided for the end packing trays and the middle packing trays. Different physical dimensions in width×length×height can also be provided for the first, second, third, and fourth supporting portions according to customer needs or requirements.

According to the one embodiment, the end packing trays 20 and the middle packing trays 30 can be made of paper, cardboard, paperboard, recycled paper, rigid plastic, polystyrene foam, biodegradable plastic, foam plastic, or recycled plastic. The carton box 10 can be made of paper, cardboard, paperboard, recycled paper, biodegradable plastic or recycled plastic.

According to the one embodiment, each of the end packing trays 20 disposed at two sides of each of the middle packing trays 30 does not directly contact the middle packing tray 30.

Figure 12B:
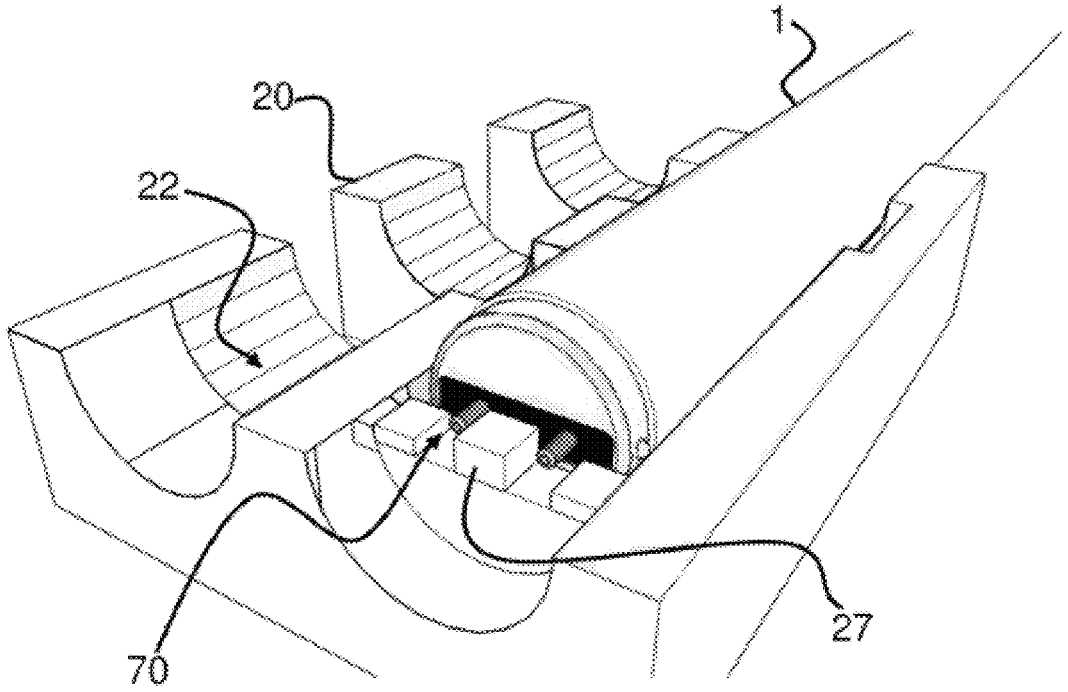
FIG. 12B is a perspective view of the placement of one tube lamp showing the tube lamp being directly, fittingly and firmly abutting the end packing tray.

Referring to FIG. 12B, the placement of one tube lamp 1 is shown, with the tube lamp 1 being directly fittingly and firmly abutting one end packing tray 20, in which the limiting protruding portion 27 of the one end packing tray 20 securely and firmly abutting one end of the tube lamp 1 while the metal pin slots 70 may or may not directly contact the metal pins of the tube lamp 1 and having the abutting end portion (not shown) of the (same) end packing tray 20 securely and firmly abutting one end of another tube lamp 1, so that one or more tube lamps can be securely contained inside the carton box 10 during transport or storage and protected against damages caused by outside shock or vibrations. In the illustrated embodiment, portions of the end packing tray 20 are omitted for clarity.

Several simulation testing were performed on the tube lamp packaging assembly 100 according to the embodiment of present invention including, for example, standard test method for impact testing for shipping containers and standard test method for simulated drop of loaded containers, and ASTM tests, and the test results indicated superb package integrity and product protection by the the tube lamp packaging assembly 100.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A tube lamp packaging assembly configured for holding a plurality of tube lamps, comprising:

a plurality of end packing trays, a plurality of first recesses is configured and formed on an upper portion of each of the end packing trays, a plurality of second recesses is configured and formed on a lower portion of each of the end packing trays, the first recesses and the second recesses are matchingly aligned, respectively, a quantity of the first recesses is larger than a quantity of the second recesses, and a metal pin slot is disposed at a far end of each of the first recesses each of the end packing trays; and a carton box, wherein the first recesses and the second recesses are in a shape of trough, respectively, the first recesses and the second recesses are staggeredly-arranged and disposed along a parallel direction to an axial direction of the tube lamps, respectively, a limiting protruding portion is disposed at the far end of each of the first recesses of each of the end packing trays, the end packing trays are disposed inside the carton box, wherein the first recesses and the second recesses of the end packing trays have the same size and shape.

2. The tube lamp packaging assembly of claim 1, wherein the end packing trays are stackingly-arranged, the first recesses of one end packing tray and the second recesses of another end packing tray are stackingly aligned vertically and directly fitted together, with the shape of the first recesses and the second recesses of each of the end packing trays being substantially symmetrical to each other thereby forming a cavity therebetween for fittingly accommodating a cylindrical shape of the tube lamps residing therebetween.

3. The tube lamp packaging assembly of claim 2, wherein the first recesses aligned in a width direction are spatially arranged in a staggered manner from the second recesses aligned in the width direction in each of the end packing trays substantially parallel to an axial direction of the tube lamps, respectively, while facing in opposite directions along a vertical direction thereof.

4. The tube lamp packaging assembly of claim 2, wherein two adjacent cavities formed by the first recesses, that are horizontally spatially arranged, are at an axial distance of 3 centimeters (cm) to 6 centimeters (cm) between center lines thereof, and two adjacent cavities formed by the second recesses, that are horizontally spatially arranged, are at an axial distance of 3 centimeters (cm) to 6 centimeters (cm) between center lines thereof.

5. The tube lamp packaging assembly of claim 3, further comprising:

a plurality of middle packing trays, a plurality of third recesses are formed on one side of each of the middle packing trays, a plurality of fourth recesses are formed on another side of each of the middle packing trays, the third recesses and the fourth recesses are matchingly aligned, respectively, the third recesses of one middle packing tray and the fourth recesses of another middle packing tray are stackingly aligned substantially vertically and directly fitted together, with the third recesses and the fourth recesses thereof being in the shape of a trough, respectively, to form a cavity therebetween, the third recesses aligned in the width direction are spatially arranged in a staggered manner from the fourth recesses aligned in the width direction in each of the middle packing trays substantially parallel to an axial direction of the tube lamps, respectively, while facing in opposite directions along a vertical direction thereof, a quantity of the first recesses is same as a quantity of the fourth recesses, and a quantity of the second recesses is same as a quantity of the third recesses.

6. The tube lamp packaging assembly of claim 5, wherein the shape of the third recesses and the fourth recesses of each of the middle packing trays being substantially symmetrical to each other, thereby forming the cavity therebetween for fittingly accommodating the cylindrical shape of one of the plurality of tube lamps residing therebetween.

7. The tube lamp packaging assembly of claim 6, wherein the cavities formed by the first recesses of one end packing tray and the second recesses of another end packing tray and the cavities formed by the third recesses of one middle packing tray and the fourth recesses of another middle packing tray are aligned in the same axial direction of the tube lamps.

8. The tube lamp packaging assembly of claim 7, wherein the cavity formed by the first recesses and the second recesses of the end packing tray and the cavity formed by the third recesses and the fourth recesses of the middle packing tray are configured for fittingly accommodating a tube lamp having a cylindrical shape residing therebetween.

9. The tube lamp packing assembly of claim 5, wherein an end packing tray is disposed at opposing edges of each middle packing tray, respectively.

10. The tube lamp packaging assembly of claim 9, wherein the end packing trays disposed on opposing edges of each middle packing tray do not directly contact the respective middle packing tray.

11. The tube lamp packaging assembly of claim 5, wherein the third recesses are formed between a plurality of third supporting portions, the third supporting portions are configured for supporting and carrying the tube lamps, the third supporting portions, surrounding each of the third recesses, are spatially arranged substantially along the axial direction of the tube lamps, the fourth recesses are formed between a plurality of fourth supporting portions, the fourth supporting portions are disposed above each of the tube lamps, the fourth supporting portions, surrounding each of the fourth recesses, are configured to be fittingly abutting the tube lamps and are spatially arranged substantially along the axial direction of the tube lamps.

12. The tube lamp packaging assembly of claim 11, wherein the third supporting portions and the fourth supporting portions of the one middle packing tray respectively, are staggeredly arranged along the axial direction of the cavity.

13. The tube lamp packaging assembly of claim 11, wherein an edge of each of the end packing trays is configured to be abutting and directly contacting the carton box, the metal pin slots are sized so that the metal pins of the tube lamps do not directly contact the metal pin slots.

14. The tube lamp packaging assembly of claim 5, wherein the widths of the first recesses, the second recesses, the third recesses, and the fourth recesses, respectively, are larger than or equal to 100% of the width of each of the tube lamps and lesser than or equal to 105% of the width of each of the tube lamps.

15. The tube lamp packaging assembly of claim 5, wherein the end packing trays and the middle packing trays are made of paper, cardboard, paperboard, recycled paper, rigid plastic, polystyrene foam, biodegradable plastic, foam plastic, or recycled plastic.

16. The tube lamp packaging assembly of claim 1, wherein the first recesses are formed between a plurality of first supporting portions, the first supporting portions are disposed below the tube lamps, the first supporting portions are configured for supporting and carrying the tube lamps, the first supporting portions surrounding the first recesses are spatially arranged substantially along the axial direction of the tube lamps, the second recesses are formed between a plurality of second supporting portions, the second supporting portions are disposed above the tube lamps, the second supporting portions surrounding the second recesses are configured to be fittingly abutting the tube lamps, the first supporting portions and the second supporting portions are spatially arranged substantially along the axial direction of the tube lamps, wherein the first supporting portions and the second supporting portions of the end packing trays have the same size and shape.

17. The tube lamp packaging assembly of claim 16, wherein the first supporting portions and the second supporting portions of the one end packing tray, respectively, are staggeredly arranged along the axial direction of the tube lamps.

18. The tube lamp packaging assembly of claim 1, wherein the metal pin slots are formed between the limiting protruding portions.

19. The tube lamp packaging assembly of claim 18, wherein each of the limiting protruding portions directly contact an end of one of the plurality of tube lamps, and an edge of each of the end packing trays is configured to directly contact the carton box, the metal pin slots are sized so that metal pins of the tube lamps do not directly contact the metal pin slots.

20. The tube lamp packaging assembly of claim 1, wherein the carton box is made of paper, cardboard, paperboard, recycled paper, biodegradable plastic or recycled plastic.

* * * * *